US005868539A

United States Patent [19]

Rathert

[11] Patent Number: 5,868,539

[45] Date of Patent: Feb. 9, 1999

[54] PROCESS AND DEVICE FOR THE MANUFACTURE OF A BOOK

[75] Inventor: Horst Rathert, Minden, Germany

[73] Assignee: Kolbus GmbH & Co., KG, Rahden, Germany

[21] Appl. No.: 928,818

[22] Filed: Sep. 12, 1997

[30] Foreign Application Priority Data

Sep. 13, 1996 [DE] Germany ..... 196 37 260.7

[51] Int. Cl.[6] ..... B42C 11/00; B42C 7/00; B42C 11/04; B42C 9/00

[52] U.S. Cl. ..... 412/5; 412/3; 412/4; 412/7; 412/8; 412/21; 412/37; 412/17; 412/18; 281/21.1; 281/36

[58] Field of Search ..... 412/1, 3, 4, 5, 412/6, 7, 8, 9, 17–24, 33, 37, 900, 902; 281/21.1, 27.1, 29, 36, 37; 402/70, 73

[56] References Cited

U.S. PATENT DOCUMENTS

| | | | |
|---|---|---|---|
| 3,201,810 | 8/1965 | Thorp . | |
| 3,292,951 | 12/1966 | Schoenberger . | |
| 3,925,126 | 12/1975 | Leatherman et al. . | |
| 4,537,545 | 8/1985 | Kunzmann | 412/7 |
| 5,066,182 | 11/1991 | Stonebraker et al. | 412/3 |
| 5,174,705 | 12/1992 | Detterman et al. | 412/1 |
| 5,536,044 | 7/1996 | Luhman et al. | 281/21.1 |
| 5,580,097 | 12/1996 | Latvakangas et al. | 281/29 |

FOREIGN PATENT DOCUMENTS

| | | |
|---|---|---|
| 1436086 | 1/1969 | Germany . |
| 2016425 | 10/1971 | Germany . |
| 87 13 282 U | 1/1988 | Germany . |
| 195 13 813 A1 | 11/1995 | Germany . |

*Primary Examiner*—Frances Han
*Attorney, Agent, or Firm*—Alix, Yale & Ristas, LLP

[57] ABSTRACT

In the manufacture of a book, the book consisting of a cover and an inner book, the book cover is permanently shaped by the formation of folds in the articulation region thereof prior to being joined to the inner book. In the course of forming the folds in the cover, the covering material thereof is caused to undergo plastic flow and to be shaped so that beneficial stresses are created in the fold defining regions. The back of the cover may also be permanently shaped substantially simultaneously with the formation of the folds.

20 Claims, 3 Drawing Sheets

PROCESS AND DEVICE FOR THE MANUFACTURE OF A BOOK

BACKGROUND OF THE INVENTION

1. Field of the Invention

The present invention relates to the art of bookbinding and, particularly, to the completion of manufacture of a book by forming the folds which define articulation areas in the cover and subsequently applying the thus shaped cover to a previously produced inner book. More specifically, this invention is directed to apparatus for use in performing a "casing-in" procedure in a book production line and, especially, to apparatus which permanently produces all of the requisite contours in a book cover immediately prior to affixation of the cover to a completed inner book. Accordingly, the general objects of the present invention are to provide novel and improved methods and apparatus of such character.

2. Description of the Prior Art

In the industrial production of "hard cover" books, i.e., in bookbinding procedures performed on a commercial scale, the final manufacturing steps which are performed are incident to the application of the book cover to the finish-machined inner book. The mating of the cover to the inner book is known in the art as "casing-in". The "casing-in" procedure, in the prior art, has been followed by an operation known as "burning-in of the folds" in which the areas about which the boards of the book cover articulate, i.e., the hinges or "folds", are formed. The "burning-in" procedure may be coupled with a step of "pressing of the book as a whole".

An example of a prior art casing-in machine is shown in published German Patent Specification 14 36 086. Inner books, standing on the front "cut" thereof, are fed into this prior art casing-in machine where they are engaged by saddle plates which comprise parts of a vertical conveyor. The thus engaged inner books are transported upwardly past oppositely disposed adhesive-applying rollers. These rollers deposit an adhesive over substantially the entire outer surfaces of the flyleaves of the inner book. A book cover, extracted from a magazine, is delivered to a shaping and folding station in which the back portion of the cover is given its requisite rounded shape through the action of a shaping rail and cooperating folding rails. The book cover with its shaped back is then moved into the path of movement of an inner book so that the rounded spine portion of the inner book will engage the complementary shaped rounded back portion of the book cover. The thus mated cover and inner book will pass between pressure rollers which ensure intimate contact between the insides of the covers and the adhesively coated flyleaves. The book is then released from the supporting saddle plate and delivered to a "burning-in" station.

An example of prior art "burning-in" apparatus may be seen from U.S. Pat. No. 2,921,322, the "burning-in" apparatus being shown as combined with a "casing-in" apparatus to form a final assembly-line stage of a bookbinding operation. The "burning-in" apparatus of U.S. Pat. No. 2,921,322 is defined by a multiplicity of pressing devices which are disposed in a straight row with uniform mutual intervals therebetween. Each of the pressing devices includes a pair of pressing plates which are located opposite to one another with a variable interval. These pressing plates apply compressive force to the sides of an engaged book. Heated rails for "burning-in" the folds, i.e., forming the hinge joints of the book, are associated with the pressing devices. These heated rails operate in pairs to shape the book cover folds.

The rails are located on a carriage and, simultaneously with forming the folds, serve as transport mechanisms to move the books stepwise from pressing station to pressing station.

The "burning-in" of the folds of the book cover, as accomplished in the prior art with the above-briefly described apparatus, is intended to produce a recessed, triangular region in the covering material of the cover along the inner edges of each of the two oppositely disposed cover boards. This recessed "fold" is, as noted, produced through the application of heat and pressure. In order to ensure that the fold will retain its shape once formed, adhesive bonding of the covering material to the underlying fold region of the inner book is affected via the application of a glue dispersion in the fold region of the inner book.

The reliable and repetitive production of a properly functioning and aesthetically acceptable product requires that the heated rails employed to "burn-in" the book cover folds cause plastic flow of the covering material of the book cover. Restated, permanent deformation of the covering material is necessary in order to counteract the restoring action of the material. The formation of the cover folds must be accomplished in such a manner that the glue dispersion in the region between the book cover covering material and inner book will be heated sufficiently to insure the formation of a bond whereby transport of the book immediately upon its release from the "burning-in" apparatus will be possible.

Prior art casing-in/burning-in systems have experienced problems due to misalignment between the cover and inner book. Also, indistinct cover fold edges have occurred as a result of inaccurate engagement with the rails for "burning-in" the folds. The problem of indistinct edges has not been overcome by resort to complicated and expensive alignment apparatus.

In the prior art, as briefly described above, the inner book is cased in the book cover at a time when the portions of the covering material which are to be shaped to produce the cover folds are in a stretched-out condition, i.e., the cover is adhesively bonded to the flyleaves of the inner book and closed. This has resulted in the "burning-in" process being difficult to perform. This difficulty, in part, results from the fact that, with the covering material already in a stretched condition, it is difficult to obtain, by further heat assisted stretching, the additional lengths of material required to form the folds. It is thus possible for the covering material to tear, or for compression creases to occur at the flyleaves, during the "burning-in" of the folds. Further, residual tensile stresses in the covering material in the fold regions, these stresses acting in a direction which tends to produce separation between the peaks of the folds and the underlying flyleaves, can lead to disruption of the adhesive bond when the pressure applied by the heated rails is relieved.

A further problem in the prior art is the overheating of the surface of the covering material which may result in the marring thereof and/or at least partial disruption of the adhesive bond between the covering material and underlying cover boards.

SUMMARY OF THE INVENTION

The present invention overcomes the above-briefly discussed and other deficiencies and disadvantages of the prior art by providing a novel and improved procedure wherein, in the course of manufacture of a book, inherently stable book cover folds are formed prior to the encasement of the inner book in the cover. The invention also encompasses apparatus which, through the application of heat and pressure before the cover is mated with an inner book, permanently shapes the book cover folds. The method and apparatus of the present invention permit more economical and reliably repetitive production of hard cover books when compared to the prior art and also provide an improvement in the quality of such books.

In accordance with a preferred mode of practice of the invention, during the course of formation of the book cover folds, the covering material is tightly bent around opposed facing edges of the cover boards so as to generally extend along cut side surfaces of the cover boards. Also in accordance with a preferred mode of practice of the invention, when the back of the book cover is rounded, this additional shaping occurs either simultaneously with or immediately subsequent to the "burning-in" of the book cover folds.

The present invention may be implemented by book cover fold burning-in apparatus which is suitable for installation in a book casing-in machine in the infeed region of the book covers. This apparatus includes heated fold-shaping rails which are capable of travel relative to the book cover for stretching the covering material of the book cover around the edges of the facing sides of the two cover boards, the cover boards being disposed on opposite sides of the back insert of the cover. The apparatus further includes heated counter-rails having contact faces which are brought into an operative relationship with the fold-shaping rails. Preferably, the apparatus further comprises a heated shaping web capable of travel relative to, and generally between, the shaping rails and counter-rails so as to influence the shape of the back portion of the cover, the shaping web having an operating face with a curvature which corresponds to the desired curvature of the cover back.

The apparatus of the present invention, since it may be installed between the book cover supply and the casing-in station, allows the elimination of the previously employed apparatus for "burning-in" of the folds downstream of the casing-in station. A book cover with inherently stable folds, as produced in accordance with the present invention, can easily be centered in an optimum manner on the inner book back during casing-in, and lopsided casing-in is thus reliably avoided. Further, since the shaping of the folds of a book cover takes place under precisely established conditions and as a result of constrained orientation of the fold-shaping rails relative to the facing edges of the cover boards, the present invention eliminates the possibility of indistinct fold edges.

The present invention also substantially eliminates the possibility of tearing of the book cover covering material or the above-mentioned formation of compression creases because the folds are burned in before the cover is "stretched", i.e., before the book cover is joined with, and adhered to, the inner book. The invention also eliminates the possibility of disruption of the adhesive bond between the book cover covering material and the inner book which has previously occurred upon release of the joint forming rails. To the contrary, a book cover shaped in accordance with the present invention is characterized by stresses in the covering material which act in a direction which will maintain contact between the regions of the book cover covering and the inner book which are to be adhesively bonded.

In accordance with the present invention, the pressing of the book as a whole can be accomplished immediately after the joining together, i.e., the casing-in, of the inner book and pre-shaped book cover. Most conveniently, and in accordance with a preferred embodiment, this pressing is accomplished by pressure rolls which form part of the book casing-in station.

The present invention also obviates the problem of possible overheating of the surface of the book cover covering material since the introduction of thermal energy into the book joint regions subsequent to "casing-in" is eliminated and less thermal energy is required because the inner book is not present to act as a heat sink during the "burning-in" of the folds.

To recapitulate, in the final stage of production of a book in accordance with the invention, a finish-machined inner book is cased into a finished book cover. The book cover, in a step performed immediately prior to the casing-in, is subjected to shaping and, particularly, to the "burning-in" of the folds. This "burning-in" is accomplished through the use of heated, profiled rails which act upon the unstretched covering material of the book cover in the regions disposed between the back insert and the cover boards. The heat from the rails renders the covering material capable of stretching, and particularly capable of plastic deformation, with the result that a durable fold articulation profile is achieved.

The step of pressing the book as a whole is optimally coupled with the procedural steps of "burning-in" the book cover folds and "casing-in" and ensures that the flyleaves of the inner book will be reliably and completely bonded to the book cover.

The book cover fold-shaping process of the present invention, and particularly the apparatus which performs this process, ensures precise positioning of the unfinished cover in relation to the working elements of the fold shaping apparatus and thereby ensures that the heated tools which "burn-in" the folds act on the covering material of the book cover at the facing side edges of the cover boards whereby, as the covering material is permanently deformed, stresses which act in a desired direction are created therein.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several Figures and in which.

DESCRIPTION OF THE DISCLOSED EMBODIMENTS

The heart of the present invention is the discovery that, unexpectedly, books can be manufactured more economically and with enhanced quality if the step of "burning-in" the folds of the book cover is performed before the step of "casing-in" the inner book in the cover, i.e., the requisite final shape is imparted to the book cover while it is still separate from the inner book rather than subsequent to its having been adhesively bonded to the inner book. The improved economy incident to the practice of the present invention, in part, results from a reduction of the energy input to the manufacturing operation. As noted above, in the prior art, the step of formation of book cover folds subsequent to "casing-in" has required a major introduction of energy in order to reduce the time period during which the glue dispersion employed to adhesively bond the cover folds to the inner book hinge joints is exposed to heating with a view to obtaining a book which is transportable immediately upon leaving the machine which performs the "burning-in" of the folds.

Figure 1:
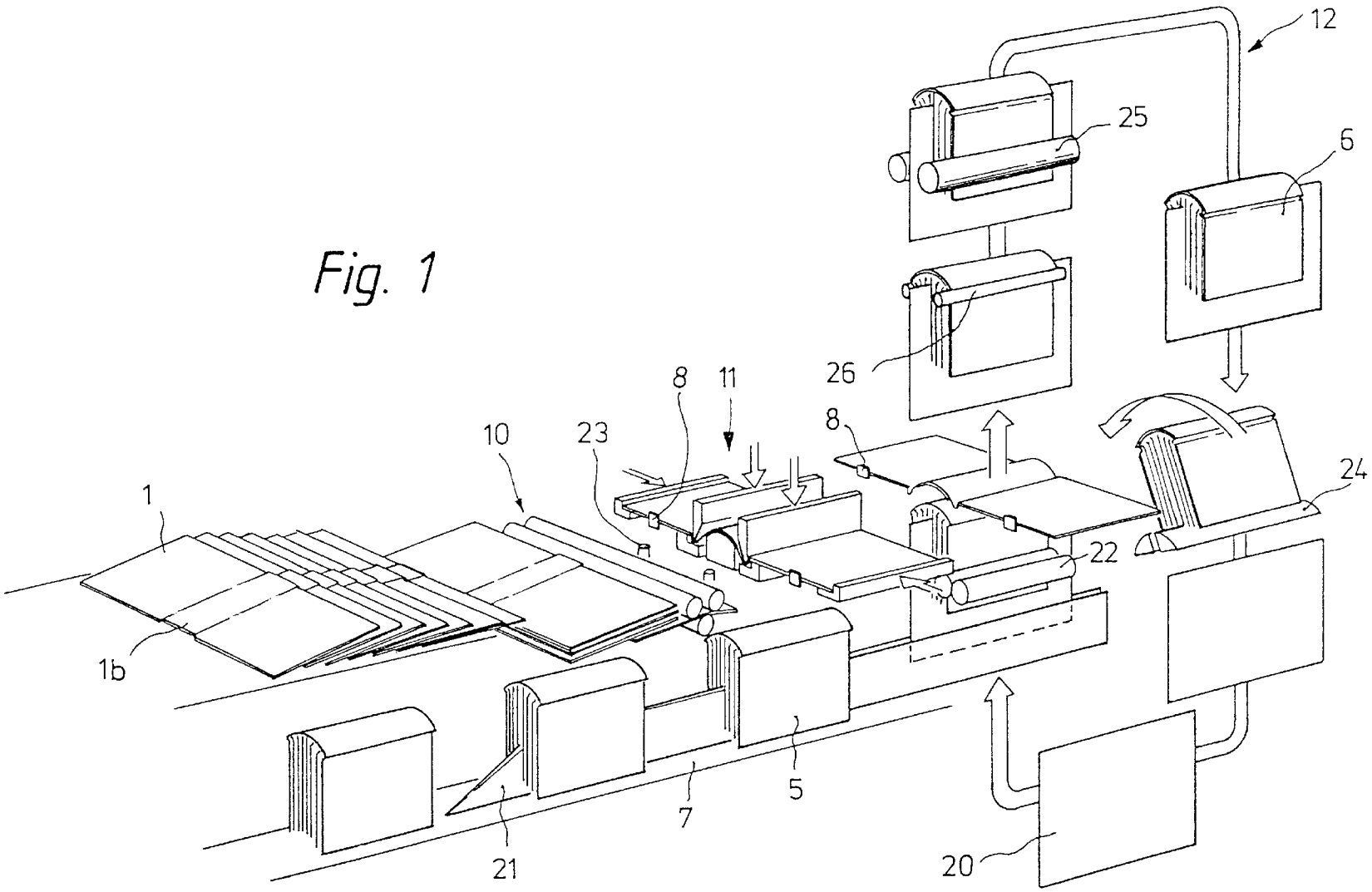
FIG. 1 is a perspective view which schematically illustrates a composite book casing-in and book cover shaping arrangement in accordance with a preferred embodiment of the invention.

With reference to the drawings, a book cover fold-shaping and back-shaping apparatus has been indicated generally at 11 in FIG. 1. The shaping apparatus 11 is located between a supply of in-coming, unshaped, i.e., substantially flat, book covers 1 and a book casing-in machine, indicated generally at 12. The in-coming book covers 1 are stacked, typically in a partially overlapping or flake-shaped formation as shown, and have their backs, indicated at 1*b,* facing upwardly. Individual book covers, after extraction from the bottom of the stack, are engaged by transporters 8 and serially moved into position in the shaping apparatus 11.

Figure 2:
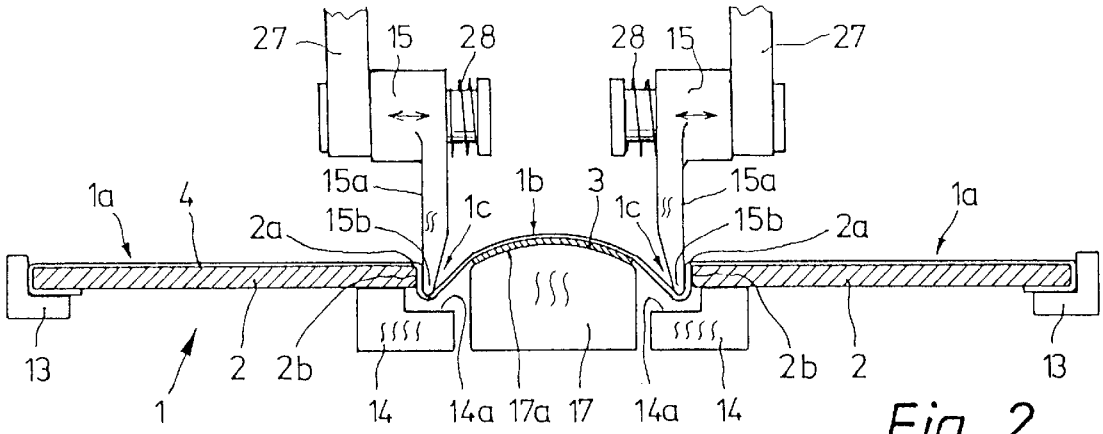
FIG. 2 is a cross-sectional, front elevational view, on an enlarged scale relative to FIG. 1, which depicts the book cover fold-shaping and back-shaping apparatus of the arrangement of FIG. 1.
Figure 4:
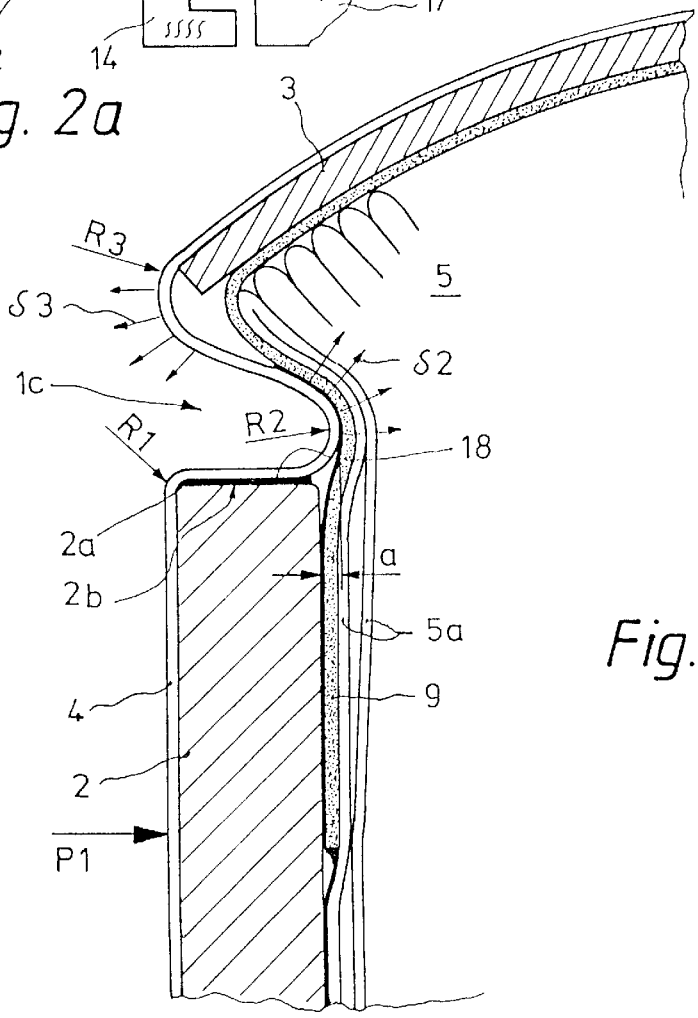
FIG. 4 is an enlarged, partial cross-sectional view of a book manufactured employing the process of the invention.

Referring jointly to FIGS. 2 and 4, the book covers 1 consist of a pair of oppositely disposed cover boards 2, a back insert 3, a sheet or layer of covering material 4, and a so-called "Schrenz" rag-paper scrap (not shown or identified by reference numeral). The oppositely disposed cover boards 2 with the adhered covering material 4 define a pair of "cappings" 1*a*. Each cover board 2 has a cut side 2*b* which extends, generally transversely with respect to the face 2*b* of the cover boards, from an edge 2*a*. The cut sides 2*b* are thus substantially parallel and face one another on opposite sides of the back insert 3. Gaps which are spanned by the covering material 4 are thus defined between the side faces 2*b* and the back insert 3.

When delivered into the shaping apparatus 11 by the transporters 8, the outer edge regions of the cappings 1*a* of a book cover 1 will be supported by respective angular, movable aligning rails 13. The cappings 1*a* will also be supported, from below and in regions adjacent to the cut sides 2*b*, by heated rails 14. The rails 14 have faces 14*a* which are offset so as to extend under the gap regions of the cover where the folds are to be formed. The rails 13 and 14 cooperate with the components to be described below to define the shaping apparatus.

Continuing to refer to FIG. 2, the disclosed book cover shaping apparatus also includes heated fold-shaping rails 15. As indicated on FIG. 3*a*, the rails 15 are movable in a transverse direction with respect to a substantially horizontal plane defined by cover 1. The spacing between rails 15 may be adjusted, by means not shown, which control the position of the rail support members 27. The rails 15 are resiliently biased in the direction of the support members, and thus in the direction of the outer side edges of cover 1, by means of springs 18. Rails 15 may thus be pushed inwardly, against the spring force, in the manner to be described below.

The heated fold-shaping rails 15 terminate, at their operative lower ends, in rounded tips 15*b*. The tips 15*b* are each sized and shaped to correspond to the desired size and shape of the apex region of the fold 1*c* which is to be formed in the book cover 1. The outwardly facing sides 15*a* of rails 15 extend generally parallel to and face respective of the cut faces 2*b* of the cover boards 2.

Figure 3A:
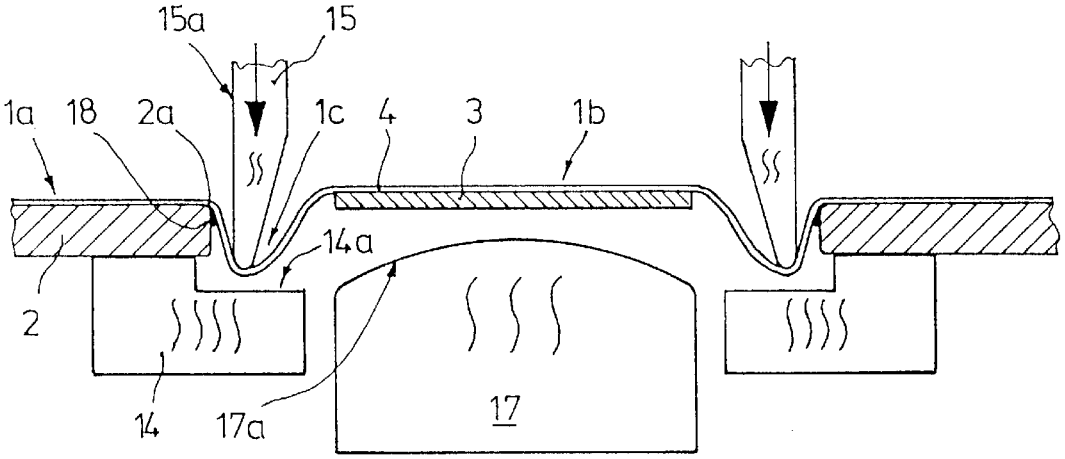
FIGS. 3*a*–3*c* are functional diagrams which depict successive phases of the operation of the book cover fold-shaping and back-shaping apparatus of FIG. 2.
Figure 3B:
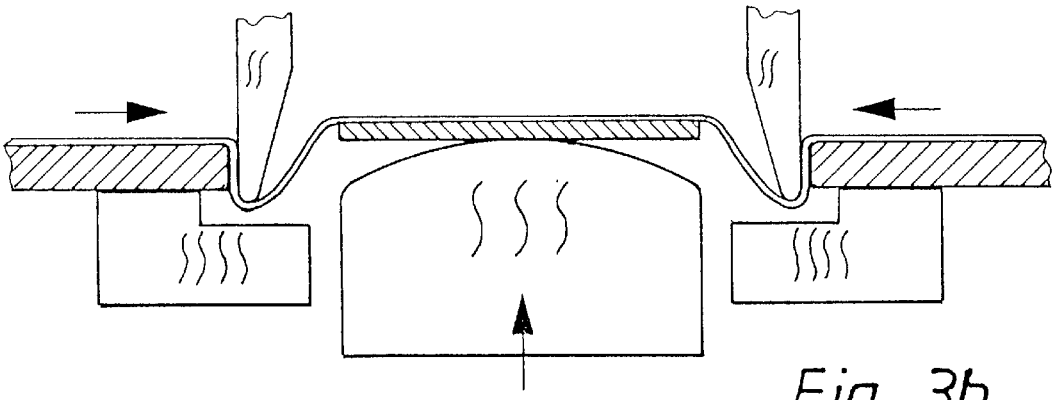
Figure 3C:
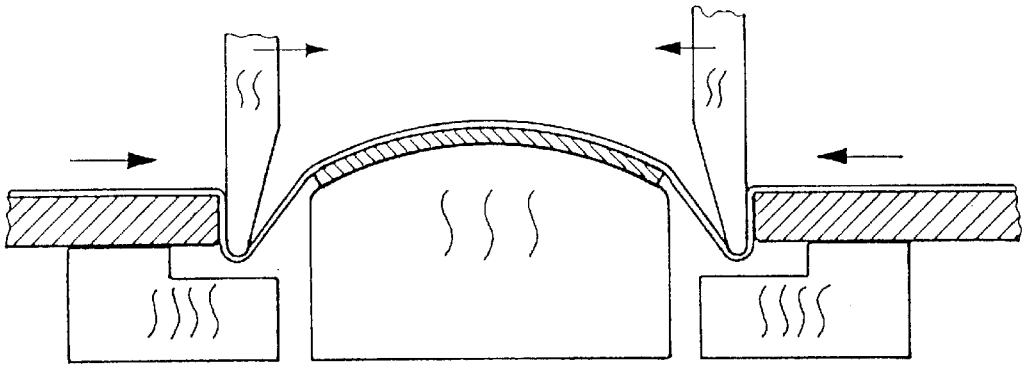

The heated fold-shaping rails 15 may be caused to travel between an upper starting position, not shown, and the lower fold-shaping position depicted in FIGS. 2 and 3 by drive means, not shown. The book cover shaping apparatus will be preadjusted such that, as the fold-shaping rails 15 descend into the working position, they will initially move past the cover board side edges 2*a* with small clearance. Accordingly, during the downward movement of rails 15, under the influence of heat and pressure, the covering material 4 of the book cover 1 is stretched around edges 2*a*. The downward movement of the rails 15 relative to the book cover 1 continues until the condition represented in FIG. 3*b* is achieved. As schematically illustrated in FIGS. 3*b* and 3*c*, the cover boards 2 are also caused to move, in a direction transverse to the movement of rails 15, to clamp the covering material 4 between the sides 15*a* of rails 15 and the sides 2*b* of the cover boards. As a result of the transfer of heat from rails 14 and 15 to covering material 4, the covering material will flow plastically in the region of the folds 1*c* and will conform to the shape of the side faces 2*b* of cover boards 2 and the adjacent tip of the shaping rails 15. The folds 1*c* will, after cooling, retain the shape which has been imparted thereto and, as will be described in greater detail in the discussion of FIG. 4, beneficial residual stresses will be created in the deformed covering material.

For the purpose of shaping the book cover back 1*b*, a heated shaping web 17 is provided in the space between the cooperating heated shaping rails 15 and heated support rails 14. The operating face 17*a* of web 17 is shaped so as to have a curvature which corresponds to the desired curvature of the book cover back. Web 17 is movable, under the influence of drive means which have not been shown, between a lower starting position as depicted in FIG. 3*a* and an upper position as depicted in FIG. 3*c*. In the upper position, the web 17 is in contact with, and is applying heat and pressure to, the cover in the vicinity of back insert 3. The cover back 1*b* will be pushed upwardly, as may be seen by comparison of FIGS. 3*b* and 3*c* and, in response to the applied heat and pressure, the covering material 4 in the region of the back 1*b* will be caused to plastically deform. The upward movement of web 17 will also contribute to the shaping of the folds 1*c*.

To summarize the above, FIGS. 3*a*–3*c* represent the phases of movement, which are executed in a convenient sequence, of the book cover fold-shaping and back-shaping operation. In this operation, the folding of the covering material 4 around the cover board edges 2*a* in the direction of the faces 14*a* of the rails 14 will initiate the operation as depicted in FIG. 3*a*. Subsequently, as shown in FIG. 3*b*, the cappings 1*a* of the book cover 1 are urged inwardly, i.e., the gap between the sides 2*b* of the cover boards is reduced, by imparting motion to the aligning rails 13 by drive means not shown. This results in the covering material 4 being sharply folded around the cover board edges 2*a*, i.e., the covering material 4 is-captured between the side faces 15*a* of the rails 15 and the side faces 2*b* of the cover boards 2. Finally, the shaping of the book cover back 1*b,* i.e., the bending of the back insert 3 and its overlying cover material 4 by the heated shaping web 17 will occur. As represented in FIG. 3*c*, the web 17 acts on the book cover back 1*b* while the covering material 4 is clamped between the fold-shaping rails 15 and the cut sides 2*b* of the cover boards. This produces tensile stresses, which will be discussed further below, in regions of the deformed cover material which are shaped so as to have a short radius.

Figure 2A:
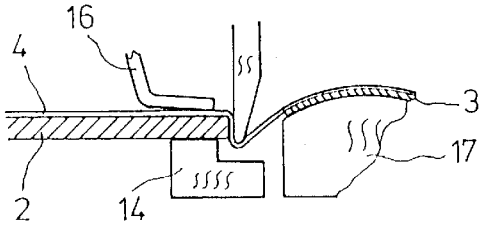
FIG. 2*a* is a partial view, taken in the same direction as FIG. 2, which depicts a modified form of the apparatus of FIG. 2.

In a modified embodiment, represented in FIG. 2*a*, the inward movement of the capping 1*a* in the direction of the resiliently supported fold-shaping rails 15 may alternatively be accomplished through the use of moveable pressure rails 16. Thus, the pressure rails 16 will frictionally engage the covering material 4 near the fold regions and cause the cappings 1*a*, which will then be clamped between the pressure rails 16 and the underlying bar 14, to move in the direction of one another. In the FIG. 2 embodiment, the bars 14 will be mounted so as to be freely displaceable in the direction of the web 17. The alternative of FIG. 2*a* has utility primarily in the case of book covers comprised of materials having a low resistance to bending.

In some instances, for example in the manufacture of books having padded covers, there is a need to take additional steps to enhance the stability of the formed cover folds 1*c*. In such cases, the cut sides 2*b* of the cover boards can be provided with an application of an adhesive such as indicated at 18 in FIG. 4. The adhesive may be applied in the shape of a chain or thread by means of nozzles 23. Through the use of a heat curable adhesive, the brief period of exposure of the adhesive to heat during the shaping process is sufficient to cause permanent fusion bonding of the covering material 4 to the cut sides 2*b* of the boards, i.e., the established adhesive bond will not be broken when the book subsequently moves from the shaping apparatus 11 into the casing-in apparatus 12.

After shaping of the cover has been completed, it will be pushed by the transporters 8 into registration apparatus 12 so as to be located in registration with an incoming inner book 5. The inner books 5 will be transported, to the casing-in apparatus 12, standing on their front cut and supported on a conveyor belt 7. As the inner books 5 move forwardly, they will be opened by a dividing member 21 which itself opens, i.e., is split, at the point of registration with the casing-in apparatus. The movement of the inner books 5 will thus be taken over, i.e., the inner books will be engaged by, saddle plates 20 which are supported from a circulating conveyor. The saddle plates 20 pass through the split in dividing member 21 and cause the generally horizontal motion of the inner books to be changed to vertical motion. This vertical motion will transport the inner books through an adhesive applicator which includes applicator rolls 22. Thus, as an inner book 5 moves upwardly, glue will be applied to the side faces or flyleaves thereof.

The preformed book cover 1 will, as noted, be transported in stretched-out orientation into the path of movement of an inner book 5 which is being carried by a saddle plate 20. In the course of its continuous upward motion, the rounded spine of the inner book 5 will be pressed into the rounded book cover back 1*b* of cover 1 to define a book 6. As the simultaneous motion of the cover and inner book continues, pressing rolls 26 will be caused to engage in the articulation regions, i.e., the folds 1*c*, between the back insert 3 and the cover boards 2 of the book cover 1. During this initial engagement of the book by the pressure rolls 26, the rolls 26 will also be travelling with, i.e., in the same direction and at the same speed as, the saddle plates 20. Subsequent to engagement, i.e., after ensuring that the hinge areas of the cover and inner book are in registration, and while remaining in engagement with the cover 1, the pressure rolls 26 will essentially reverse their direction of motion and roll along the cover 1 of the moving book 6. The requisite adhesive bond will thus be established between the inwardly directed faces of the cover boards 2 and the adhesively coated side faces or flyleaves of the inner book. The book 6 continues to move forward carried by the saddle plate 20. Ultimately, the book will arrive at a laying-out web 24 which, as schematically illustrated in FIG. 1, will cause the finished book to tip over onto a discharge conveyor which will deliver the book for packaging and/or storage. The saddle plate 20 will continue to move downwardly and, in so doing, will pass through a slot provided therefor in the web 24.

A pair of pressing rolls 25 may be installed along the transport path of the book 6 at an appropriate location between the casing-in station 12 and the bookbinding machine discharge conveyor. As shown in FIG. 1, the pressure rolls 25 are located immediately above the casing-in station and perform the function of pressing the completed book 6 as a whole. Alternatively, the pressing rolls 25 may be integrated into the casing-in apparatus and/or may take the form of strips, plates or any other mechanism for receiving books 6 and applying compressive force thereto to expel entrapped air.

FIG. 4 shows the details of a book 6 manufactured employing the method and apparatus of the invention. The book 6 includes an inner book 5, comprised of signatures, and a pre-shaped cover. The book cover of FIG. 4, as mentioned above, consists of the covering material 4, the cover boards 2, the back insert 3 and the so-called "Schrenz" rag-paper scrap. FIG. 4 shows slip-folding material 9 disposed between the cover and inner book. The end-papers 5*a* of the inner book 5 will be adhesively bonded to the inside of the cover boards 2.

The thermal shaping of the book cover 1 in the shaping apparatus 11, as discussed above, results in inherently stable book cover folds 1*c*. The folds 1*c* have a radius R2 at their apex and the covering material, in the region of radius R2, will be characterized by tensile stresses S2 which act in the direction shown by the arrows on FIG. 2. The folds 1*c* further have an inherently stable radius R3 in the region of the book cover back and the covering material in the region of radius R3 is also stressed, i.e., has tensile stresses S3 which result in forces acting in the direction of the arrows on FIG. 4. Finally, the folds 1*c* are further characterized by a very tight radius R1 where the covering material passes around the edge 2*a* of the cover board. When the book cover 1 is pressed into engagement with the flyleaf or end-paper 5*a* by a force P1, the stresses S2, which are in the direction of opening the fold, ensure contact between the covering material and the inner book 5 in the region of the fold 1*c*. The stresses created during formation of the folds thus maintain the contact necessary for ensuring that an adhesive bond will be created between the apex of the fold 1*c* and the hinge region of the inner book via a previously applied adhesive (not numbered on FIG. 4). The extent of the applied pressure is indicated at "a" on FIG. 4. The glue dispersion which adhesively bonds the folds 1*c* in the cover to the inner book is shown in FIG. 4 as disposed between the covering material 4 and the slip-folding material 9. This glue will be activated by heat, i.e., the solvent will be driven off, and transferred to covering material 4 by contact pressure, i.e., through the action of rolls 26. The resulting adhesive bond will be maintained in part by the above-mentioned tensile stresses.

While preferred embodiments have been shown and described, various modifications and substitutions may be made thereto without departing from the spirit and scope of the invention. Accordingly, the present invention has been described by way of illustration and not limitation.

What is claimed is:

1. In a process for the manufacture of a book, the book consisting of an inner book which is cased into a book cover, the inner book having a spine region and the book cover including spaced cover boards with facing oppositely disposed side surfaces and a back insert located between and displaced from said side surfaces, the book cover also including a deformable covering material which extends over the cover boards and back insert, the covering material being provided with folds which define articulation regions in registration with the spaces between the cover boards and back insert, the improvement comprising:

forming inherently stable folds in the covering material under the action of heat before casing-in of the inner book into the book cover.

2. The process of claim 1 wherein the step of forming the stable book cover folds comprises:

bending the covering material around edges of said oppositely disposed side surfaces of the cover boards and causing the thus bent covering material to extend along the said facing side surfaces of the cover boards.

3. The method of claim 1 further comprising the step of:

shaping the book cover back through the application of heat and pressure whereby the back of the book cover is permanently formed into a shape which is generally complementary to the spine of the inner book, the shaping of the book cover back also being performed prior to casing-in.

4. The method of claim 1 wherein the step of forming the stable book cover folds is performed immediately before the casing-in of the inner book into the book cover and includes causing plastic flow of the covering material.

5. The method of claim 1 further comprising:

applying an adhesive to the said side surfaces of the cover boards prior to forming the folds whereby the said oppositely disposed side surfaces of the cover boards will be bonded to the folded covering material during the formation of the folds.

6. The method of claim 1 further comprising the step of:

pressing the book as a whole subsequent to the casing-in of the inner book into the book cover.

7. The method of claim 1 further comprising:

establishing an adhesive bond between the folds of the covering material and the underlying inner book.

8. The method of claim 7 wherein the step of establishing an adhesive bond includes creating contact pressure between the covering material in the region of the folds and the underlying inner book by closing the cover over the inner book to thereby cause locking engagement of the cover folds and the inner book.

9. The method of claim 1 wherein the inner book includes depressed hinge joint defining regions in the sides thereof and wherein the step of casing-in of the inner book into the book cover includes:

pressing the folds of the cover into the hinge joint regions of the inner book to establish form-locking engagement therebetween.

10. The method of claim 9 wherein the inner book includes depressed hinge joint defining regions in the sides thereof and wherein the step of forming the stable folds in the book cover includes:

applying heat and pressure to the covering material in the regions which bridge the gaps between the cover boards and back insert; and simultaneously bending the heated covering material around edges of said oppositely disposed facing side surfaces of the cover boards and causing the thus bent covering material to extend along the said side surface of the cover board by clamping the covering material against said side surfaces whereby the covering material will flow plastically; and wherein said method further comprises:

applying heat and pressure to the book cover back insert whereby the back insert of the book cover is permanently formed into a shape which is generally complementary to the shape of the spine region of the inner book, the shaping of the book cover back also being performed prior to casing-in; and establishing an adhesive bond between the folds of the covering material and the underlying inner book, said step of establishing an adhesive bond including pressing the folds of the cover into the hinge joint regions of the inner book to establish form-locking engagement therebetween.

11. In apparatus for the manufacture of a book, the apparatus including a casing-in station for mating book covers with previously formed inner books, the book covers being comprised of spacially displaced cover boards and a back insert disposed therebetween and spaced therefrom, the spacing between the back insert and the cover boards defining a pair of generally parallel gaps, said gaps being bridged by a deformable covering material which extends over the back insert and at least partly over the cover boards, the cover boards having respective facing side surfaces which define first sides of the gaps, the covers being premanufactured in flat form whereby the faces of the cover boards which are contacted by the covering material define a plane, the improvement comprising:

apparatus for forming folds in the covering material of a flat book cover where the covering material bridges the back insert defined gaps, said fold-forming apparatus being installed in the in-feed region through which the covers are delivered to the casing-in station, said fold-forming apparatus including movable heated fold-shaping rails and means for causing said rails to move in a direction generally transverse to the plane defined by a flat book cover in which the folds are to be produced, said fold-shaping rails bending the covering material around the edges of the facing side surfaces of the cover boards whereby the covering material is permanently deformed and the covers are thus provided with stable folds prior to being mated with inner books;

means for delivering flat book covers to said fold-forming apparatus; and means for transporting shaped book covers from said fold-forming apparatus to said casing-in station.

12. The apparatus of claim 11 wherein said fold-shaping apparatus further comprises:

heated counter-rails which transfer heat into the covering material, each of said counter-rails engaging a cover board adjacent a said side surface thereof.

13. The apparatus of claim 11 wherein said fold-shaping rails each have an operating face which is oriented substantially parallel to a side surface of a cover board and a leading tip end having in part a non-linear contour commensurate with at a least a portion of the shape of the desired book cover fold, said operating face being positioned in closely spaced facing relationship with a cooperating cover board side surface.

14. The apparatus of claim 11 wherein said fold-forming apparatus further comprises:

a heated shaping web, said shaping web being movable and being disposed on the opposite side of the book cover with respect to said fold-shaping rails, said web being located in registration with the book cover back insert, said web having an operating surface for engagement with the cover back insert whereby heat and pressure may be delivered to the back insert and to the covering material extending thereover through the back insert, said operating face of said web having a shape which corresponds to the shape of the spine region of the inner book, said web being movable relative to said fold-shaping rails so as to be at least in part disposed therebetween.

15. The apparatus of claim 11 wherein said fold-forming apparatus further comprises:

a pair of movable pressure rails for engaging a flat book cover in the region of the cover boards thereof to selectively cause motion of the cover boards and overlying cover material in a direction which will reduce the width of said gaps, said pressure rails thereby causing the clamping of said covering material between a fold-shaping rail and a said side surface of a cover board.

16. The apparatus of claim 11 further comprising:

means for applying an adhesive to said facing side surfaces of said cover boards prior to delivery of the cover to said fold-forming apparatus.

17. The apparatus of claim 11 further comprising:

means for forming deposits of adhesive whereby said book cover folds may be adhesively bonded to an inner book at the casing-in station.

18. The apparatus of claim 11 wherein said fold-shaping apparatus further comprises:

pair of oppositely disposed aligning rails, said aligning rails respectively engaging and supporting an edge of a book cover board disposed oppositely with respect to a said gap defining cover board side surface, said aligning rails being movable toward one another to reduce the width of said gaps, movement of said aligning rails to reduce said gap widths being synchronized with the movement of said fold-shaping rails whereby the covering material which is bent around the edges of the facing side surfaces of the cover boards will be clamped between a fold-shaping rail and a side surface of a cover board.

19. The apparatus of claim 18 wherein said fold-shaping rails each have an operating face which is oriented substantially parallel to a side surface of a cover board and a leading tip end having in part a non-linear contour commensurate with at a least a portion of the shape of the desired book cover fold, said operating face being oriented for positioning in closely spaced facing relationship with a cooperating cover board side surface and wherein said fold-shaping apparatus further comprises:

heated counter-rails which cooperate with said shaping rails to transfer heat into the covering material, said counter-rails each engaging a cover board adjacent a said side surface thereof to support the engaged cover board during movement of said fold-shaping rails.

20. The apparatus of claim 19 further comprising:

means for applying an adhesive to said facing side surfaces of said cover boards prior to delivery of the cover to said fold-forming apparatus, said adhesive applying means including applicator nozzles for depositing said adhesive on said side surfaces.

* * * * *